US011663953B2

(12) United States Patent
Liu et al.

(10) Patent No.: US 11,663,953 B2
(45) Date of Patent: May 30, 2023

(54) DRIVER CHIP, DISPLAY SCREEN, AND DISPLAY DEVICE

(71) Applicant: SEEYA OPTRONICS CO., LTD., Shanghai (CN)

(72) Inventors: Ping-Lin Liu, Shanghai (CN); Yanfu Huang, Shanghai (CN); Zhenyong Gao, Shanghai (CN)

(73) Assignee: SEEYA OPTRONICS CO., LTD., Shanghai (CN)

( * ) Notice: Subject to any disclaimer, the term of this patent is extended or adjusted under 35 U.S.C. 154(b) by 0 days.

(21) Appl. No.: 17/793,113

(22) PCT Filed: Mar. 26, 2021

(86) PCT No.: PCT/CN2021/083264
§ 371 (c)(1),
(2) Date: Jul. 15, 2022

(87) PCT Pub. No.: WO2022/095328
PCT Pub. Date: May 12, 2022

(65) Prior Publication Data

US 2023/0048669 A1 Feb. 16, 2023

(30) Foreign Application Priority Data

Nov. 3, 2020 (CN) ..... 202011206657.5

(51) Int. Cl.
*G09G 3/20* (2006.01)

(52) U.S. Cl.
CPC ..... *G09G 3/2074* (2013.01); *G09G 2310/027* (2013.01); *G09G 2310/0286* (2013.01); *G09G 2320/0276* (2013.01)

(58) Field of Classification Search
CPC ..... G09G 3/2074; G09G 2310/027; G09G 2310/0286; G09G 2320/0276
See application file for complete search history.

(56) References Cited

U.S. PATENT DOCUMENTS

2006/0290641 A1 12/2006 Ku et al.
2016/0063957 A1* 3/2016 Shirasaki ..... G11C 19/28 345/213
2019/0206330 A1* 7/2019 Kim ..... G09G 3/3233

FOREIGN PATENT DOCUMENTS

CN 1776801 5/2006
CN 105869558 8/2016
(Continued)

OTHER PUBLICATIONS

First Search dated Dec. 8, 2020 for Corresponding Chinese Patent Application No. 202011206657.5.
(Continued)

*Primary Examiner* — Muhammad N Edun
(74) *Attorney, Agent, or Firm* — Duane Morris LLP

(57) ABSTRACT

Provided are a driver chip, a display screen and a display device. The driver chip is configured to drive a silicon-based display screen, and the driver chip is composed of a bridge chip and a screen driver chip. A signal interface circuit of a first signal processing circuit in the bridge chip receives video signals of each frame of picture. A drive controller controls video signals of P pixels among the video signals of one frame of picture to be output at a first preset transmission speed to a second signal processing circuit of the screen driver chip each time. A signal processor of the second signal processing circuit in the screen driver chip converts the video signals of all of the P pixels into data drive signals and outputs at a second preset transmission speed data drive signals of Q pixels in one frame of picture to a data processing circuit each time. The data processing circuit is configured to convert the data drive signals into display driving signals, sequentially output the display driving signals to pixels in each row, and control each pixel.

15 Claims, 8 Drawing Sheets

(56) References Cited

FOREIGN PATENT DOCUMENTS

| | | |
|---|---|---|
| CN | 108257538 | 7/2018 |
| CN | 208477893 | 2/2019 |
| CN | 109818610 | 5/2019 |
| CN | 109935195 | 6/2019 |
| CN | 112102770 | 12/2020 |

OTHER PUBLICATIONS

International Search Report dated Jul. 5, 2021 for Corresponding PCT Application No. PCT/CN2021/083264.
First Office Action dated Dec. 25, 2020 for Corresponding Chinese Patent Application No. 202011206657.5.

* cited by examiner

DRIVER CHIP, DISPLAY SCREEN, AND DISPLAY DEVICE

CROSS-REFERENCES TO RELATED APPLICATIONS

This is a National Stage Application, filed under 35 U.S.C. 371, of International Patent Application No. PCT/CN2021/083264, filed on Mar. 26, 2021, which is based on and claims priority to Chinese Patent Application No. 202011206657.5 filed with the China National Intellectual Property Administration (CNIPA) on Nov. 3, 2020, the disclosure of which is incorporated herein by reference in its entirety.

TECHNICAL FIELD

Embodiments of the present application relate to the field of display technologies, for example, a driver chip, a display screen, and a display device.

BACKGROUND

A silicon-based display is a combination of a display and a monocrystalline silicon integrated circuit. An obvious feature of the silicon-based display is that pixels in the display are formed on a silicon-based substrate through a complementary metal-oxide-semiconductor (CMOS) process, so that the silicon-based display has characteristics such as a relatively low cost and a relatively small volume.

The silicon-based display generally includes a display screen and a driver chip. The driver chip may drive pixels in the display screen for display. In a conventional process, the driver chip and the display screen are formed on a same silicon-based substrate. However, with development of the display technologies, a display effect of the silicon-based display is continuously improved, so that the driver chip needs to be manufactured by a high-order process. The pixels in the display are manufactured simply by a low-order process. If the display and the driver chip are still formed on the same silicon-based substrate, a manufacturing cost of the silicon-based display is undoubtedly increased. Therefore, how to reduce the manufacturing cost of the silicon-based display and improve a product yield of the silicon-based display under a premise that the silicon-based display may have a high-quality display effect becomes an urgent technical problem to be solved.

SUMMARY

Embodiments of the present application provide a driver chip, a display screen, and a display device so as to reduce a manufacturing cost of a silicon-based display and improve a product yield of the silicon-based display.

In a first aspect, the driver chip provided by the embodiments of the present application is configured to drive a silicon-based display screen. The silicon-based display screen includes pixels arranged in M rows and N columns. M and N are each a positive integer.

The driver chip includes a bridge chip and a screen driver chip. The bridge chip includes a first substrate and a first signal processing circuit disposed on one side of the first substrate. The first signal processing circuit includes a signal interface circuit and a drive controller. The screen driver chip includes a second substrate and a second signal processing circuit disposed on one side of the second substrate.

The second signal processing circuit includes a signal processor and a data processing circuit.

The signal interface circuit is configured to receive video signals of each frame of picture.

The drive controller is electrically connected to the signal processor. The drive controller is configured to control video signals of P pixels among the video signals of one frame of picture to be output at a first preset transmission speed to the signal processor each time. P is a positive integer, and $P<N$.

The signal processor is electrically connected to the data processing circuit. The signal processor is configured to convert the video signals of the P pixels into data drive signals and output at a second preset transmission speed data drive signals of Q pixels in the one frame of picture to the data processing circuit each time. Q is a positive integer, and $Q \leq N$.

The data processing circuit is configured to convert the data drive signals into display driving signals, sequentially output the display driving signals to pixels in each row, and control each of the pixels for display.

In a second aspect, the display screen further provided by the embodiments of the present application includes the driver chip.

The second substrate of the screen driver chip includes a display area and a non-display area surrounding the display area. The pixels are configured in the display area, and the second signal processing circuit is configured in the non-display area.

In a third aspect, the display device provided by the embodiments of the present application further includes the display screen.

The embodiments of the present application provide the driver chip, the display screen, and the display device. The driver chip includes the bridge chip and the screen driver chip. The first signal processing circuit having a relatively high transmission speed is disposed on the first substrate of the bridge chip. The second signal processing circuit having a low transmission speed requirement is disposed on the second substrate of the screen driver chip. Therefore, the first signal processing circuit and the second signal processing circuit are formed by using different substrates in different processes, so that the bridge chip may be manufactured by using a high-order process, and the screen driver chip may be manufactured by using a low-order process, thereby being conducive to reducing a manufacturing cost of the driver chip. Meanwhile, the video signals received by the signal interface circuit of the first signal processing circuit in the bridge chip may be output by the drive controller of the first signal processing circuit. The drive controller may control the number of video signals output to the second signal processing circuit in the screen driver chip each time. In such way, if the drive controller of the first signal processing circuit in the bridge chip controls the number of video signals output to the second signal processing circuit to be relatively small each time, the number of signal lines and/or connection terminals electrically connecting the bridge chip and the screen driver chip is relatively small, which is conducive to reducing a risk that the bridge chip cannot transmit the video signals to the screen driver chip due to poor contact of the signal lines and/or the connection terminals, thereby being conducive to improving the accuracy of signal transmission and a production yield of the driver chip.

DETAILED DESCRIPTION

Figure 1:
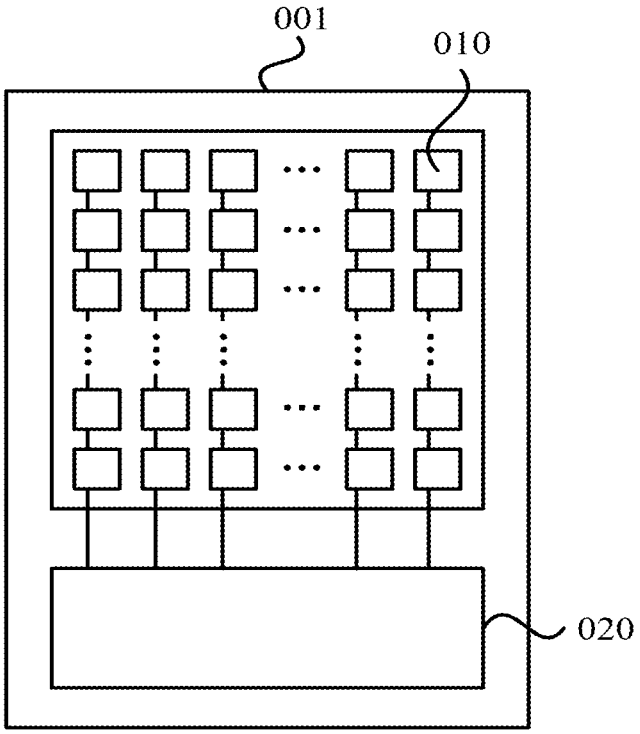
FIG. 1 is a structural diagram of a driver chip of a silicon-based display screen in a related art.

As shown in FIG. 1, pixels 010 in a silicon-based display screen and a driver chip 020 for driving the silicon-based display screen are generally disposed on a same substrate 001 in the related art, so that the driver chip 020 and the pixels 010 in the silicon-based display screen need to be formed under a condition of same process. As display requirements on the silicon-based display screen are increased, a processing speed of a signal processing circuit in the driver chip 020 is continuously increased, so that the driver chip 020 needs to be manufactured under a process condition meeting a relatively high requirement. In such way, when the pixels 010 in the silicon-based display screen and the driver chip 020 are manufactured under the condition of same process, a manufacturing cost of the silicon-based display screen is undoubtedly increased, which is not conducive to improving a production yield of the silicon-based display screen.

However, when the driver chip 020 and the pixels 010 in the silicon-based display screen are manufactured using different substrates, respectively, the driver chip 020 needs to be electrically connected to the pixels 010 in the silicon-based display screen through corresponding connection terminals and/or signal lines so as to transmit corresponding data drive signals to the pixels 010 and drive the pixels 010 for display. In such way, the connection terminals need to be configured both on a substrate side on which a driver chip is disposed and a substrate side on which the pixels of the silicon-based display screen is disposed, the number of the connection terminals is equivalent to the number of pixels 010 in each row, and/or the signal lines need to be configured between the substrate on which the driver chip is disposed and the substrate on which the pixels of the silicon-based display screen are disposed, and the number of the signal lines is equivalent to the number of pixels 010 in each row. When the number of pixels 010 in each row is relatively large, a relatively large number of signal lines and/or connection terminals need to be disposed. When a yield of the signal lines and the connection terminals is constant, the more the signal lines and/or the connection terminals are disposed, the more unfavorable it is to improve the production yield of the silicon-based display screen, thereby increasing the manufacturing cost of the silicon-based display screen and reducing a display effect of the silicon-based display screen.

To solve above technical problems, an embodiment of the present application provides a driver chip. The driver chip is configured to drive a silicon-based display screen, and the silicon-based display screen includes pixels arranged in M rows and N columns. M and N are each a positive integer. The driver chip includes a bridge chip and a screen driver chip. The bridge chip includes a first substrate and a first signal processing circuit disposed on one side of the first substrate. The first signal processing circuit includes a signal interface circuit and a drive controller. The screen driver chip includes a second substrate and a second signal processing circuit disposed on one side of the second substrate. The second signal processing circuit includes a signal processor and a data processing circuit. The signal interface circuit is configured to receive video signals of each frame of picture. The drive controller is electrically connected to the signal processor. The drive controller is configured to control video signals of P pixels among the video signals of one frame of picture to be output at a first preset transmission speed to the signal processor each time. P is a positive integer, and $P<N$. The signal processor is electrically connected to the data processing circuit. The signal processor is configured to convert the video signals of the pixels into data drive signals and output at a second preset transmission speed data drive signals of Q pixels in one frame of picture to the data processing circuit each time. Q is a positive integer, and $Q\leq N$. The data processing circuit is configured to convert the data drive signals into display driving signals, sequentially output the display driving signals to pixels in each row, and control each of the pixels for display.

The first signal processing circuit disposed on the first substrate in the bridge chip may decode, transmit, and perform other operations on the video signals received. Therefore, the first signal processing circuit needs to have a relatively high processing speed to meet the high display requirements of the silicon-based display screen. The second signal processing circuit disposed on the second substrate in the screen driver chip may perform storage, digital-to-analog conversion and other operations on signals output from the first signal processing circuit. Therefore, the second signal processing circuit does not need to have a relatively high processing speed.

As described above, according to above technical solutions, on the one hand, the first signal processing circuit and the second signal processing circuit are disposed on the first substrate and the second substrate, respectively, so that the first signal processing circuit formed on the first substrate and the second signal processing circuit formed on the second substrate may be manufactured by using different processes, and thus a high-order process is adopted for the first signal processing circuit with high requirements for manufacturing conditions, and a low-order process is adopted for the second signal processing circuit with low requirements for manufacturing conditions. Therefore, a production cost of the second signal processing circuit may be reduced, and the production yield of the second signal processing circuit may be increased, and thus an overall cost of the driver chip may be reduced, and the production yield of the driver chip may be increased. On the other hand, the driver chip is divided into the bridge chip and the screen driver chip. After the video signals of each frame of picture are received by the signal interface circuit of the first signal processing circuit in the bridge chip, the drive controller of the first signal processing circuit controls the number of video signals output to the second signal processing circuit of the screen driver chip each time, and the drive controller controls the number of video signals output to the signal processor of the second signal processing circuit each time to be smaller than the number of pixels in each row. Compared with a case where the signal processing circuit of the driver chip and the pixels of the silicon-based display screen are manufactured on different substrates, the embodiment of the present application merely uses the connection terminals and/or the signal lines, the number of which is equivalent to the number of video signals output each time, to achieve that the bridge chip and the screen driver chip may be electrically connected to each other, which is conducive to improving the production yield of the driver chip and reducing the production cost of the driver chip. Therefore, the production yield of the silicon-based display screen including the driver chip may be improved and the production cost of the silicon-based display screen including the driver chip may be reduced.

Figure 2:
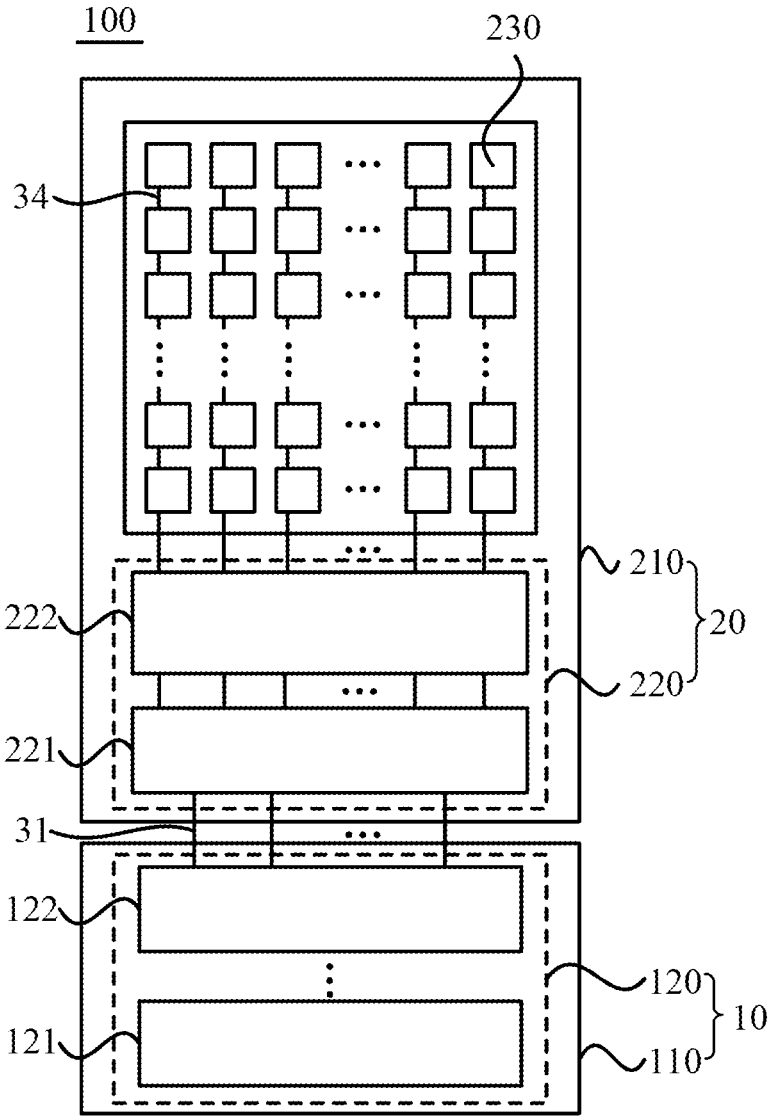
FIG. 2 is a structural diagram of a driver chip according to an embodiment of the present application.

FIG. 2 is a structural diagram of a driver chip according to an embodiment of the present application. As shown in FIG. 2, a driver chip 100 can drive the silicon-based display screen to display a corresponding picture. The silicon-based display screen may include pixels are arranged in M rows and N columns, that is, each row includes N pixels. The driver chip 100 provides the display driving signals to the pixels 230 in the silicon-based display screen so that the pixels 230 in the silicon-based display screen present light of different colors and/or brightness according to the display driving signal. The light displayed by the pixels 230 is combined to form the picture to be displayed on the silicon-based display screen. Generally, a plurality of data signal lines 34 are configured in the silicon-based display screen, and the pixels 230 in a same column share one data signal line 34. Therefore, when the silicon-based display screen includes N columns of pixels 230, N data signal lines 34 may be configured in the silicon-based display screen accordingly. In this case, the driver chip 100 needs to provide the display driving signals for the pixels 230 in a row-by-row manner.

In the embodiment of the present application, the driver chip 100 includes a bridge chip 10 and a screen driver chip 20. The screen driver chip 20 is a chip provided with the pixels 230 of the silicon-based display screen and external circuits of the pixels 230. The bridge chip 10 includes a first substrate 110 and a first signal processing circuit 120 disposed on one side of the first substrate 110, and the screen driver chip 20 includes a second substrate 210 and a second signal processing circuit 220 disposed on one side of the second substrate 210. That is, the first signal processing circuit 120 of the bridge chip 10 and the second signal processing circuit 220 of the screen driver chip 20 are formed on different substrates, so that the first signal processing circuit 120 of the bridge chip 10 and the second signal processing circuit 220 of the screen driver chip 20 may be formed under different process conditions. Therefore, corresponding manufacturing processes may be selected according to respective performance requirements of the first signal processing circuit 120 and the second signal processing circuit 220.

The first signal processing circuit 120 includes at least a signal interface circuit 121 and a drive controller 122. The signal interface circuit 121 may receive the video signals of each frame of picture, and the video signals may drive the pixels 230 in the silicon-based display screen to display. When the signal interface circuit 121 receives the video signals of one frame of picture, the video signals of the frame of picture are usually high-speed serial analog signals. The signal interface circuit 121 converts the analog signals received into corresponding digital signals, and the digital signals are subjected to a high-speed processing process such as decompression through other modules of the first signal processing circuit 120 and output to the second signal processing circuit 220 through the drive controller 122 of the first signal processing circuit 120. The drive controller 122 of the first signal processing circuit 120 may control transmission speeds of the video signals of each frame of picture received by the signal interface circuit 121. That is, the video signals of each frame of picture may be output at the first preset transmission speed to the second signal processing circuit 220. When the transmission speed is relatively high, the number of pixels 230 corresponding to the video signals output each time is relatively small. Therefore, when the drive controller 122 outputs the video signals of each frame of picture at a relatively high first preset transmission speed, the drive controller 122 may output the video signals of P pixels 230 to a signal processor 221 of the second signal processing circuit 220 each time. P is a positive integer, and $P<N$. That is, the number of pixels 230 corresponding to the video signals output from the drive controller 122 each time is smaller than the number of pixels 230 in each row in the silicon-based display screen.

In this manner, when video signals of each frame of picture received by the signal interface circuit 121 are the high-speed serial analog signals, and the drive controller 122 outputs the video signals of each frame of picture at a relatively high speed, it is favorable to improve a refresh frequency, display brightness and the like of the silicon-based display screen. Meanwhile, when the first signal processing circuit 120 has a relatively high operational speed, the high-order process with relatively high production process conditions and relatively high accuracy requirements is needed to form the first signal processing circuit 120 on the first substrate 110, so that the bridge chip 10 may have a relatively high yield on a premise that the first signal processing circuit 120 formed on the side of the first substrate 110 has a relatively high operational speed bridge chip and thus the manufacturing cost of the bridge chip 10 may be reduced.

The second signal processing circuit 220 includes the signal processor 221 and a data processing circuit 222. The signal processor 221 is electrically connected to the drive controller 122 of the first signal processing circuit 120. The signal processor 221 receives the video signals output from the drive controller 122, converts the video signals received into the data drive signals, and then outputs the data drive signals of Q pixels at the second preset transmission speed to the data processing circuit 222 electrically connected to the signal processor 221. Q is a positive integer, and $Q \leq N$. That is, the number of pixels 230 corresponding to the data drive signals output from the signal processor 221 each time may be smaller than the number of pixels 230 in each row or may be equal to the number of pixels 230 in each row, so that the signal processor 221 may output the data drive signals at a relatively low second preset transmission speed. In this case, the first preset transmission speed may be greater than the second preset transmission speed, and $P<Q$.

Exemplarily, when the drive controller 122 controls video signals of each frame of picture to be outputted in a form of video signals of thirty-two pixels at a frequency of 45 MHz each time, and the signal processor 221 outputs the data drive signals of sixty-four pixels at a frequency of 22.5 MHz each time, the signal processor 221 merely divides the received video signals of the thirty-two pixels each time into the data drive signals of the sixty-four pixels. That is, the video signals received by the signal processor 221 and the data drive signals output from the signal processor 221 are each the digital signals, and digital-to-analog conversion is not performed. After the signal processor 221 outputs the data drive signals to the data processing circuit 222, the data processing circuit 222 may perform digital-to-analog conversion on the received signals so as to convert the data drive signals into the display driving signals which may directly drive the pixels for display. Moreover, the display driving signals are sequentially provided for pixels in each row through corresponding data signal lines 34 so that the pixels may be displayed according to the display driving signals received by each pixel. According to this configuration, the number of pixels 230 corresponding to the data drive signals output from the signal processor 221 each time may be twice the number of pixels 230 corresponding to the video signals output from the drive controller 122 each time.

In this manner, the signal processor 221 and the data processing circuit 222 of the second signal processing circuit 220 do not need to have a relatively high computation and transmission speed. The signal processor 221 merely needs to divide the video signals received into a corresponding number of data drive signals, and the data processing circuit 222 converts the data drive signals into the display driving signals through the digital-to-analog conversion. Therefore, the second signal processing circuit 220 does not need to have a relatively high computational processing speed, and the second signal processing circuit 220 is formed on the second substrate 210 by simply using the low-order process with relatively low production process conditions and relatively low accuracy requirements so that the manufacturing cost of the screen driver chip 20 is reduced on a premise of ensuring a relatively high yield of the screen driver chip 20.

Exemplarily, the first substrate 110 and the second substrate 210 may each be a silicon-based substrate. The high-order process for forming the first signal processing circuit 120 on the first substrate 110 and the low-order process for forming the second signal processing circuit 220 on the second substrate 210 may each be a CMOS process, but specific formation conditions of the first signal processing circuit 120 and the second signal processing circuit 220 may vary according to respective performances. On the premises that the yields of the bridge chip 10 and the screen driver chip 20 may be improved, and the cost of the bridge chip 10 and the screen driver chip 20 may be reduced, the embodiment of the present application is not specifically limited to these.

In addition, the second signal processing circuit 220 in the screen driver chip 20 uses the low-order process, which is equivalent to the process used by the pixels 230 in the silicon-based display screen. Therefore, the second signal processing circuit 220 in the screen driver chip 20 and the pixels 230 in the silicon-based display screen are both formed on the second substrate 210 under same process conditions, thereby simplifying process steps of the silicon-based display screen and reducing the cost of the silicon-based display screen.

Further, the drive controller 122 of the first signal processing circuit 120 may be electrically connected to the signal processor 221 of the second signal processing circuit 220 through the signal lines and/or the connection terminals. Exemplarily, when the drive controller 122 is electrically connected to the signal processor 221 through the signal lines 31, each signal line 31 may serially output a corresponding number of video signals. That is, the number of signal lines 31 configured to electrically connect the drive controller 122 and the signal processor 221 should be equivalent to the number of pixels 230 corresponding to the video signals output from the drive controller 122 each time. When the drive controller 122 outputs the video signals of P pixels 230 at the first preset transmission speed each time, P signal lines 31 configured to transmit the video signals need to be disposed. The drive controller 122 of the first signal processing circuit 120 may control the number of pixels corresponding to the video signals output to the signal processor 221 of the second signal processing circuit 220 each time. Therefore, when the number of pixels corresponding to the video signals output at a relatively high first transmission speed from the drive controller 122 is relatively small, the number of signal lines 31 configured to electrically connect the drive controller 122 and the signal processor 221 and disposed between the bridge chip 10 and the screen driver chip 20 is relatively small. When the number of signal lines 31 disposed is relatively small, the process of manufacturing the signal lines 31 may be relatively simple, and a qualification rate of the signal lines 31 may be relatively high, which is conducive to improving the accuracy of the video signals output from the drive controller 122 to the signal processor 221, thereby improving the yield of the driver chip 100, reducing the cost and power consumption of the driver chip 100, and further reducing the power consumption and cost of the silicon-based display screen, and improving the display effect of the silicon-based display screen.

In the embodiment of the present application, the signal interface circuit 121 of the first signal processing circuit 120 is, for example, but not limited to, a physical layer (PHY) interface (e.g. PHY chip). A type of the signal interface circuit is not specifically limited by the embodiment of the present application on a premise that the signal interface circuit 121 may receive the high-speed serial analog signals.

Figure 3:
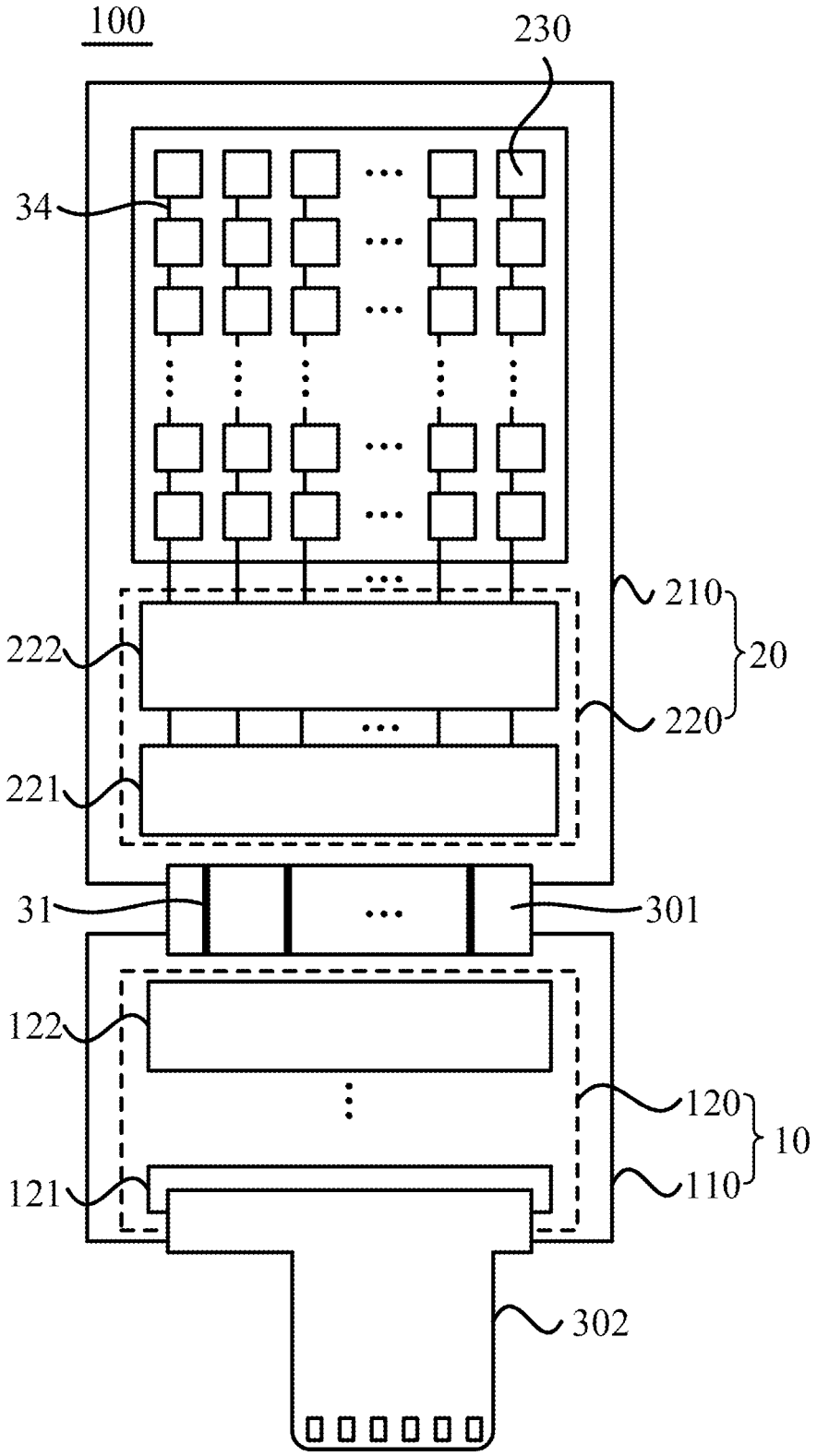
FIG. 3 is a structural diagram of another driver chip according to an embodiment of the present application.

Optionally, FIG. 3 is a structural diagram of another driver chip according to an embodiment of the present application. As shown in FIG. 3, the driver chip 100 further includes a connector 301 configured to electrically connect the bridge chip 10 and the screen driver chip 20 and/or a connector 302 configured to electrically connect the bridge chip 10 and a system motherboard (not shown in FIG. 3). In this manner, the first signal processing circuit 120 of the bridge chip 10 may output the video signals to the second signal processing circuit 220 of the screen driver chip 20 through the connector 301. Accordingly, the first signal processing circuit 120 of the bridge chip 10 may receive through the connector 302 the video signals of each frame of picture provided from the system motherboard.

The connector 301 configured to electrically connect the bridge chip 10 and the screen driver chip 20 may be provided with corresponding connection terminals, signal lines, and the like. When the drive controller 122 of the first signal processing circuit 120 controls the number of pixels corresponding to the video signals output each time to be relatively small, the connector 301 may be provided with a relatively smaller number of connection terminals and signal lines. In this manner, the design of the connector 301 may be simplified, which is conducive to improving the product yield of the connector 301 and reducing the manufacturing cost of the connector 301. Accordingly, the video signals of each frame of picture generated by the system motherboard may be transmitted to the bridge chip 10 through the connector 302 and received by the signal interface circuit 121 of the bridge chip 10. Exemplarily, the connectors 301 and 302 may include, but are not limited to, a printed circuit board or a flexible circuit board.

Figure 4:
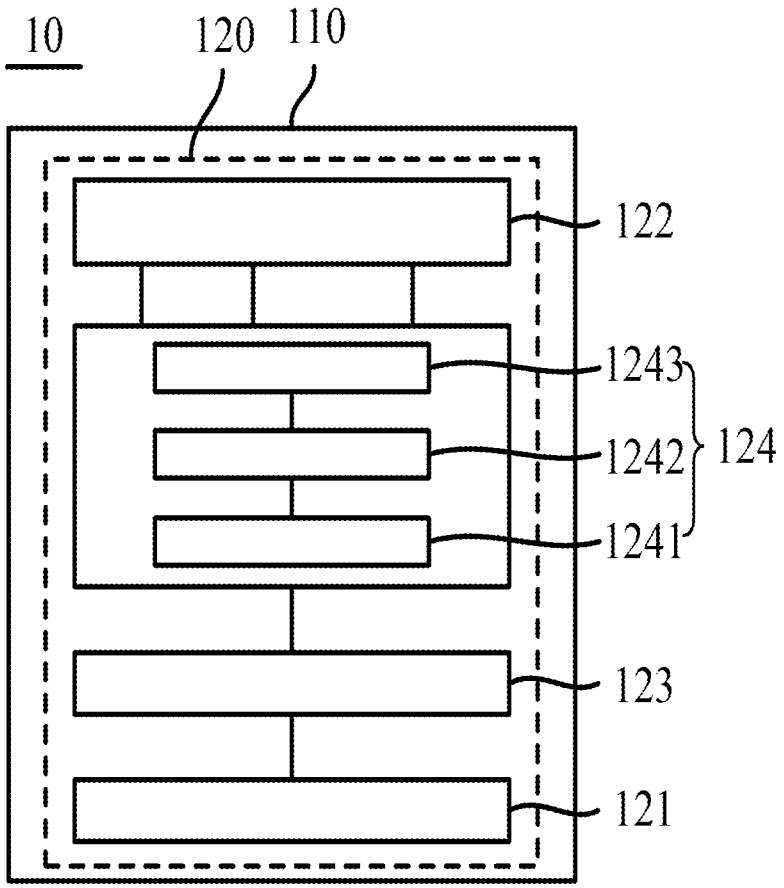
FIG. 4 is a structural diagram of a bridge chip according to an embodiment of the present application.

Optionally, FIG. 4 is a structural diagram of a bridge chip according to an embodiment of the present application. As shown in FIG. 4, the first signal processing circuit 120 of the bridge chip 10 further includes a digital signal decoder 123. The digital signal decoder 123 is electrically connected to the signal interface circuit 121. The digital signal decoder 123 may decode the video signals of each frame of picture received by the signal interface circuit 121 and output the video signals of K pixels among the video signals of one frame of picture at a third preset transmission speed. The third preset transmission speed is greater than the second preset transmission speed, and K≤P. K is a positive integer.

The digital signal decoder 123 may decode the video signals of each frame of picture received by the signal interface circuit 121 into eight-bit RGB signals or digital signals of another format (Mobile Industry Processor Interface (MIPI), High Definition Multimedia Interface (HDMI), Video Graphics Array (VGA), NTSC (National Television System Committee), Society of Motion Picture and Television Engineers (SMPTE), or the like), output the decoded video signals at the third preset transmission speed greater than the second preset transmission speed and less than or equal to the first preset transmission speed, and output the video signals of K pixels each time. In this manner, the digital signal decoder 123 needs to have a relatively high decoding speed so that when the higher-order process is used to manufacture the first signal processing circuit 120, requirements on decoding speed of the digital signal decoder 123 may be met, and meanwhile the bridge chip 10 may be ensured to have relatively low power consumption.

Optionally, with continued reference to FIG. 4, the first signal processing circuit 120 further includes a signal correction circuit 124. The signal correction circuit 124 is electrically connected to the digital signal decoder 123 and the drive controller 122 separately. The signal correction circuit 124 may perform color correction on the video signals of the pixels in each frame of picture and perform pixel compensation on the video signals of each frame of picture, thereby improving the display effect of each frame of picture and ensuring that the silicon-based display may accurately display the corresponding picture.

The signal correction circuit 124 may include a gamma correction circuit 1241, a saturation and grayscale processing circuit 1242, and a border pixel compensation circuit 1243 which are sequentially electrically connected. In this manner, the gamma correction circuit 1241 may be used to perform gamma correction on the video signals decoded by the digital signal decoder 123 so as to make the displayed picture have a relatively high contrast. The saturation and grayscale processing circuit 1242 is used to perform a biasing adjustment on the video signals having subjected to the gamma correction so as to form final brightness signals input to each pixel unit so that the displayed picture may have relatively high display brightness and the display effect may be improved. In addition, the silicon-based display screen includes not only the pixels for normal display but also virtual pixels disposed at a bezel position. Therefore, the border pixel compensation circuit 1243 is needed to provide the video signals of the virtual pixels disposed at the bezel position so that the display driving signals finally output may be in one-to-one correspondence with the pixels in the silicon-based display screen to improve the display effect of the silicon-based display screen.

Figure 5:
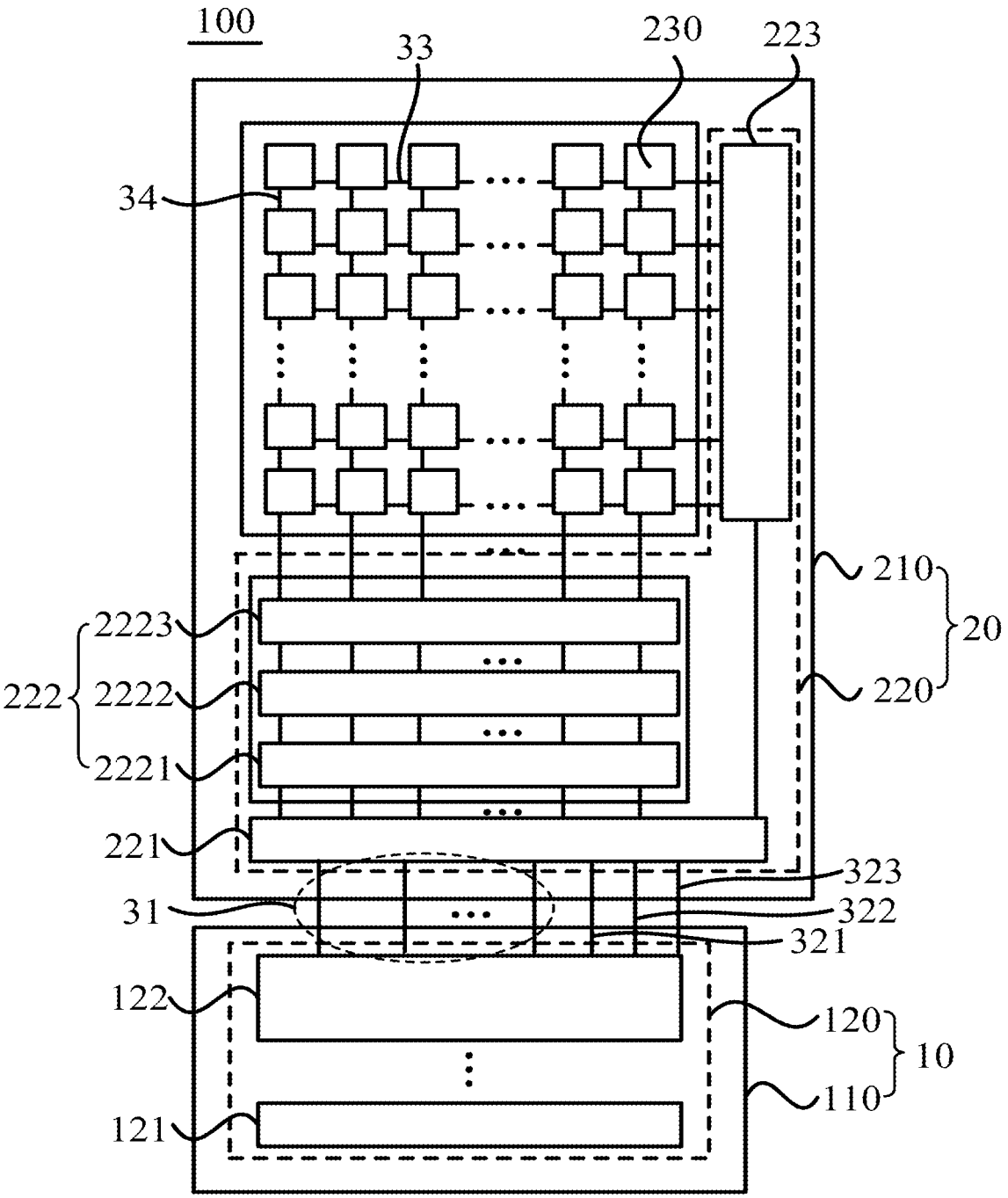
FIG. 5 is a structural diagram of another driver chip according to an embodiment of the present application.

Optionally, FIG. 5 is a structural diagram of another driver chip according to an embodiment of the present application. As shown in FIG. 5, the data processing circuit 222 includes a storage circuit 2221, a digital-to-analog conversion circuit 2222, and a data driver 2223. The signal processor 221 further receives row synchronization signals and data-write control signals output from the drive controller 122 and outputs the data drive signals and clock trigger signals of the pixels according to the row synchronization signals and the data write control signals at the second preset transmission speed. The storage circuit 2221 is electrically connected to the signal processor 221 and the digital-to-analog conversion circuit 2222 separately. The storage circuit 2221 includes a plurality of storage sub-circuits corresponding to one row of pixels 230. All storage sub-circuits correspondingly store the data drive signals of the pixels 230 disposed in the same row. The storage circuit 2221 receives the data drive signals of the pixels 230 output from the signal processor 221 and controls the data drive signals of the pixels 230 in the same row according to the clock trigger signals to be output to the digital-to-analog conversion circuit 2222 so that the digital-to-analog conversion circuit 2222 converts the data drive signals of the pixels into the display driving signals and outputs the display driving signals to the data driver 2223. The data drive signals are digital signals and the display driving signals are analog signals. An output terminal of the data driver 2223 is correspondingly electrically connected to each column of pixels 230, for example, the data driver 2223 may be electrically connected to each column of pixels 230 through the data signal lines 34 each electrically connected to the same column of pixels 230. In this case, the data driver 2223 may sequentially output the display driving signal of pixels in each row 230 to the pixels 230 at a preset drive timing so as to drive each of the pixels 230 for display.

The drive controller 122 of the first signal processing circuit 120 outputs the video signals of P pixels to the signal processor 221 of the second signal processing circuit 220 each time and meanwhile outputs the row synchronization signals and the data write control signals to the signal processor 221, so that the signal processor 221 may distinguish the video signals of each pixel 230 and each row of pixels 230 according to the row synchronization signals and the data write control signals and output the data drive signals of each row of pixels to the storage circuit 2221 for storage. Although the drive controller 122 merely outputs the video signals of P pixels each time, the video signals of the pixels may be distinguished by the row synchronization signals and the data write control signals output from the drive controller. Thus, P signal lines 31 for transmitting the video signals of P pixels, one signal line 321 for transmitting the row synchronization signals, one signal line 323 for transmitting the column synchronization signals and one signal line 322 for transmitting the data write control signals need to be configured between the bridge chip 10 and the screen driver chip 20. That is, (P×i×j+3) signal lines are configured between the bridge chip 10 and the screen driver chip 20, so that when the number of pixels corresponding to the video signals output from the drive controller 122 each time is relatively small, the number of signal lines configured to electrically connect the bridge chip 10 and the screen driver chip 20 may be reduced, thereby simplifying the design of the driver chip, ensuring the accuracy of signal transmission between circuits of the driver chip, reducing the power consumption, and improving the display effect. Where i denotes the number of sub-pixels included in each pixel, and j denotes the number of bytes of each video signal. For example, each pixel may include three sub-pixels. That is, i is equal to 3. Each video signal may have 8 bits, that is, j is equal to 8, which is merely taken as an example. On the premise that core application points of the embodiment of the present application may be achieved, the embodiment of the present application does not specifically limit values of i and j.

Meanwhile, after the storage circuit 2221 stores the data drive signals of one row of pixels, the signal processor 221 may output corresponding clock trigger signals to the storage circuit 2221 so that the storage circuit 2221 may simultaneously output the data drive signals of one row of pixels to the digital-to-analog conversion circuit 2222. The digital-to-analog conversion circuit 2222 may convert the data drive signals into the display driving signals that may directly drive the pixels 230, and output the display driving signals to pixels in each row 230 at the preset drive timing through the data driver 2223, so as to drive pixels in each row 230 to emit light and display each frame of picture.

Figure 6:
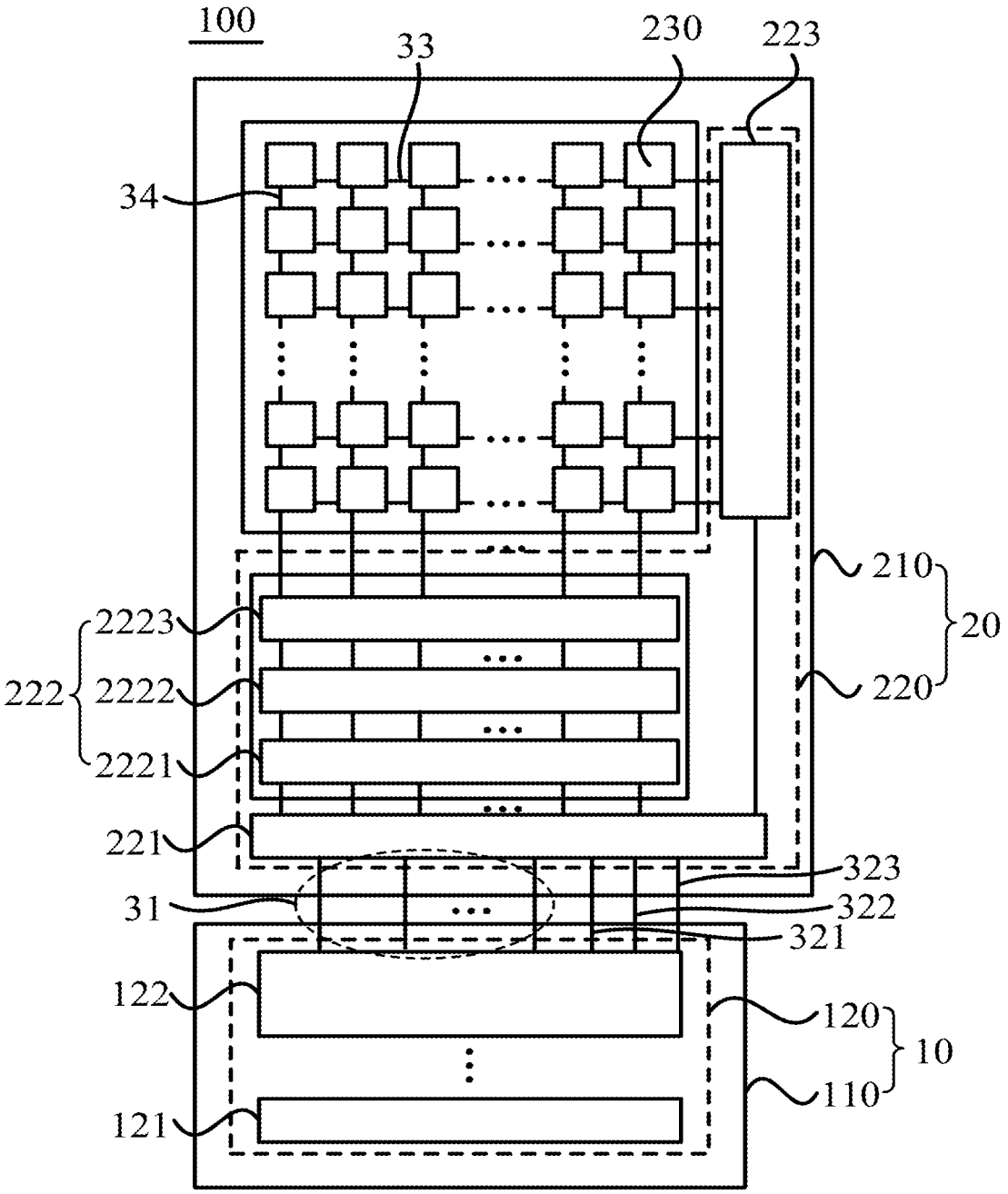
FIG. 6 is a structural diagram of a screen driver chip according to an embodiment of the present application.

Optionally, FIG. 6 is a structural diagram of a screen driver chip according to an embodiment of the present application. Still referring to FIG. 5 and FIG. 6, the storage circuit 2221 includes a vertical shift register 2201 and a latch 2202. The vertical shift register 2201 includes a plurality of vertical shift register circuits 22011 corresponding to the pixels 230 in the same row. The latch 22021 includes a plurality of latch circuits 22021 corresponding to the pixels 230 in the same row. In this manner, the data drive signals output from the signal processor 221 may be stored sequentially in the vertical shift register circuits 22011 of the vertical shift register 2201, and when the plurality of vertical shift register circuits 22011 each store a corresponding data drive signal, the signal processor 221 outputs the corresponding clock trigger signals to the vertical shift register 2201 so that the plurality of vertical shift register circuits 22011 in the vertical shift register 2201 simultaneously output the data drive signals to the plurality of latch circuits 22021 of the latch 2202 for latching.

FIG. 6 illustrates merely the embodiment of the present application as an example. The data drive signals output from the signal processor 221 in FIG. 6 are first stored in the vertical shift register 2201 and then output to the latch 2202. In the embodiment of the present application, the data drive signals output from the signal processor may be first stored in a latch and then output to a vertical shift register for storage, which is not specifically limited by the embodiment of the present application.

Optionally, still referring to FIG. 5 and FIG. 6, the digital-to-analog conversion circuit 2222 includes a digital-to-analog converter 2203 and a gamma voltage generator 2204. The gamma voltage generator 2204 is electrically connected to the digital-to-analog converter 2203. The gamma voltage generator 2204 may output a gamma voltage to the digital-to-analog converter 2203 so that the digital-to-analog converter 2203 converts the data drive signals into the display driving signals in a one-to-one correspondence according to the gamma voltage and the data drive signals and outputs the display driving signals to the data driver 2223 electrically connected to the digital-to-analog converter 2203.

Optionally, still referring to FIG. 5, the second signal processing circuit 220 further includes a row driver 223. The signal processor 221 is further electrically connected to the row driver 223. The signal processor 221 further receives the column synchronization signals and the data write control signals output from the drive controller 122 and outputs first clock control signals to the row driver 223 according to the column synchronization signals and the data write control signals. An output terminal of the row driver 223 is electrically connected to a respective one row of pixels 230, for example, the pixels disposed in the same row may share a scanning signal line 33, and the row driver 223 may be electrically connected to each row of pixels through each scanning signal line. The row driver 223 can sequentially provide row drive signals to each row of pixels 230 according to the first clock control signals, so that each of the display driving signals is written into a respective row of pixels 230.

The pixel mentioned in the embodiment of the present application may be a sub-pixel or a pixel circuit including a plurality of different sub-pixels, which is not specifically limited by the embodiment of the present application on the premise that the core application points of the embodiment of the present application can be achieved.

Optionally, with continued reference to FIG. 6, when each pixel 230 includes a plurality of sub-pixels 231, 232 and 233 in different colors, the second signal processing circuit 220 may further include a plurality of multiplex gating circuits 240 and a plurality of clock signal lines 35. Each of the plurality of multiplex gating circuits 240 includes a plurality of switching circuits 241. An input terminal of each of the plurality of switching circuits 241 of a same multiplex gating circuit 240 is electrically connected to a same display driving signal output terminal of the data processing circuit 222. Control terminals of the plurality of switching circuits 241 of the same multiplex gating circuit 240 are electrically connected to different clock signal lines. An output terminal of each of the plurality of switching circuits 241 is electrically connected to a respective one column of sub-pixels.

Exemplarily, each pixel 230 may include three sub-pixels 231, 232, and 233 of different colors, and the colors of the sub-pixels 231, 232, and 233 may include, for example, but not limited to, red, green, and blue. In this case, each multiplex gating circuit 240 may include three switching circuits 241, and each switching circuit 241 may include a transistor. In this manner, when the transistor of the switching circuit 241 is an N-channel metal-oxide semiconductor (NMOS) and signals transmitted by the clock signal line 35 electrically connected to the switching circuit 241 are at a high level, the transistor of the switching circuit 241 can be controlled to turn on so that the display driving signals output from the data processing circuit 222 can be transmitted through the transistor turned on to a corresponding column of sub-pixels. When the transistor of the switching circuit 241 is a P-channel metal-oxide semiconductor (PMOS) and the signals transmitted by the clock signal line 35 electrically connected to the switching circuit 241 are at a low level, the transistor of the switching circuit 241 can be controlled to turn on so that the display driving signals output from the data processing circuit 222 can be transmitted through the transistor turned on to a corresponding column of sub-pixels.

Correspondingly, a clock signal output terminal of the data processing circuit 222 is electrically connected to each of the clock signal lines 35. The data processing circuit 222 can output different second clock control signals to the clock signal lines 35 so that each of the switching circuits 241 is turned on or off under control of each of the second clock control signals. When the second clock control signals control the switching circuits 241 to turn on, the display driving signals are controlled to be transmitted to all columns of sub-pixels in a one-to-one correspondence.

The embodiment of the present application further provides a display screen. The display screen includes the driver chip provided by the embodiments of the present application. Therefore, the display screen includes technical features of the driver chip provided by the embodiments of the present application and beneficial effects of the driver chip provided by the embodiments of the present application. For similarities, refer to description of the driver chip provided by the embodiments of the present application, and repetition is not made herein.

Figure 7:
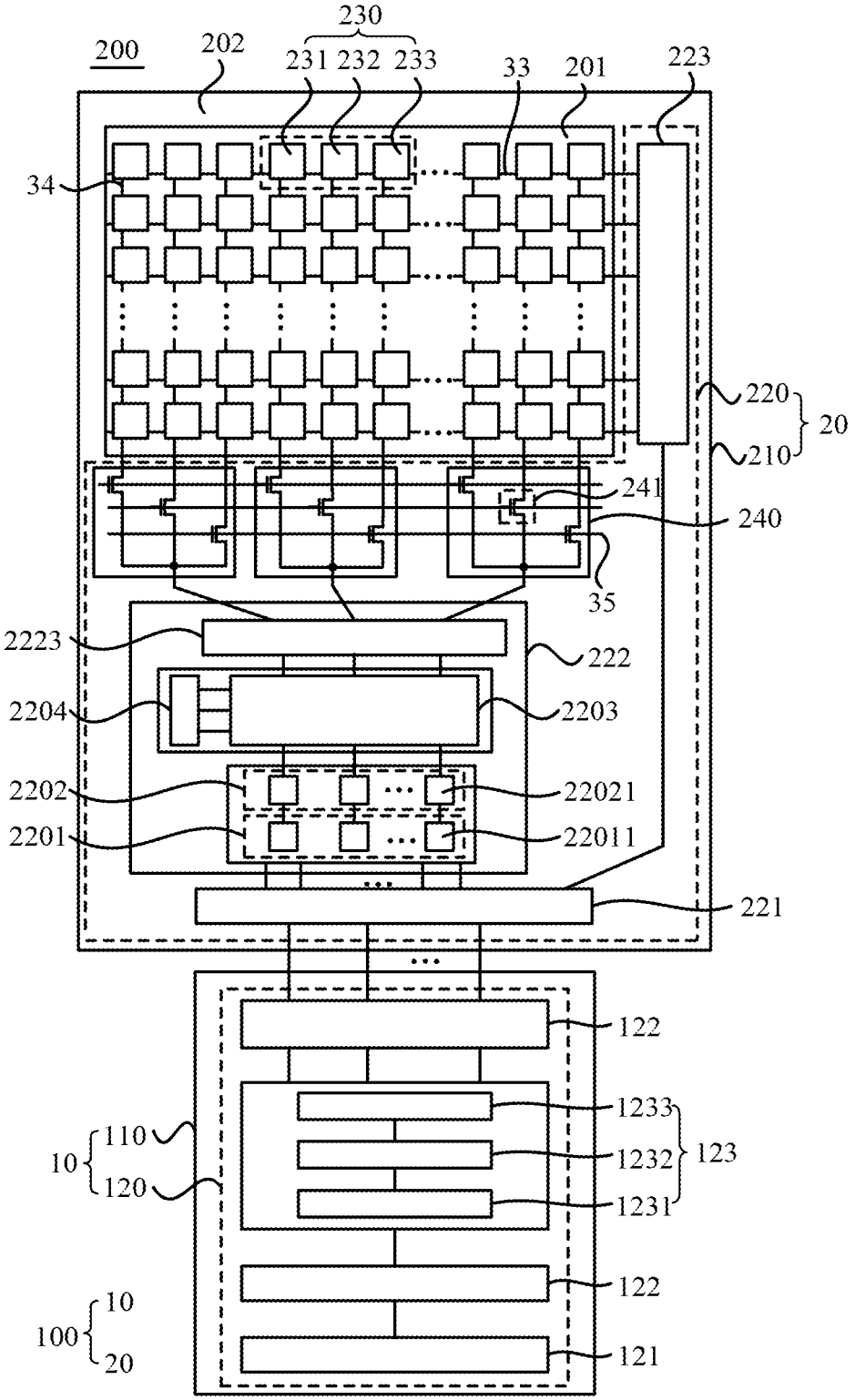
FIG. 7 is a structural diagram of a display screen according to an embodiment of the present application.

Exemplarily, FIG. 7 is a structural diagram of a display screen according to an embodiment of the present application. As shown in FIG. 7, a display screen 200 includes the driver chip 100 provided by the embodiments of the present application. The second substrate 210 of the screen driver chip 20 of the driver chip 100 includes a display area 201 and a non-display area 202 surrounding the display area 201. The pixels 230 of the display screen are configured in the display area 201, and the second signal processing circuit 220 is configured in the non-display area 202. In this manner, the pixels of the display screen and the second signal processing circuit 220 may be disposed on the same substrate 210 so as to simplify the manufacturing process of the display screen and reduce the production cost of the display screen. The display screen includes, for example, the silicon-based display screen.

The embodiments of the present application further provide a display device. The display device includes the display screen provided by the embodiment of the present application. Therefore, the display device has technical features and beneficial effects of the display screen provided by the embodiment of the present application. For similarities, refer to description of the display screen provided by the embodiment of the present application, and repetition is not made herein.

Figure 8:
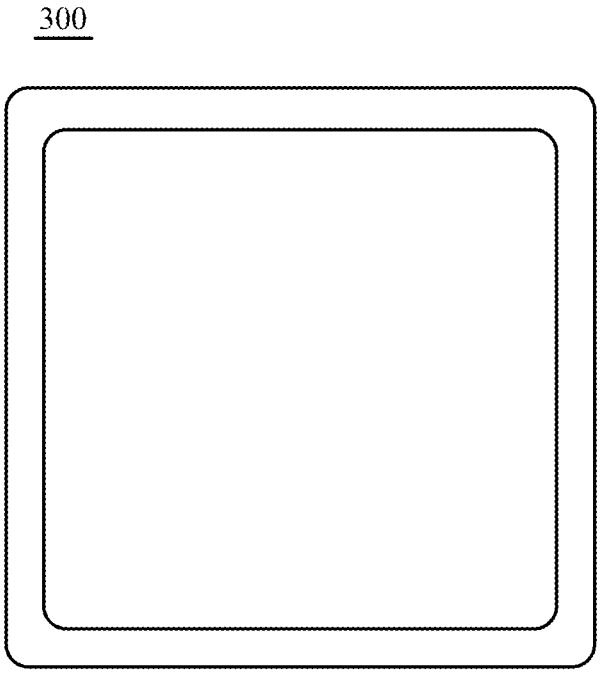
FIG. 8 is a structural diagram of a display device according to an embodiment of the present application.

Exemplarily, FIG. 8 is a structural diagram of a display device according to an embodiment of the present application. As shown in FIG. 8, a display device 300 may be, for example, an augmented reality (AR) device, a virtual reality (VR) device, or the like, which is not specifically limited by the embodiment of the present application.

What is claimed is:

1. A driver chip, the driver chip being configured to drive a silicon-based display screen, wherein the silicon-based display screen comprises pixels arranged in M rows and N columns, and M and N are each a positive integer;

wherein the driver chip comprises a bridge chip and a screen driver chip, the bridge chip comprises a first substrate and a first signal processing circuit disposed on one side of the first substrate, and the first signal processing circuit comprises a signal interface circuit and a drive controller;

wherein the screen driver chip comprises a second substrate and a second signal processing circuit disposed on one side of the second substrate, and the second signal processing circuit comprises a signal processor and a data processing circuit;

wherein the signal interface circuit is configured to receive video signals of each frame of picture;

wherein the drive controller is electrically connected to the signal processor, the drive controller is configured to control video signals of P pixels among the video signals of one frame of picture to be output at a first preset transmission speed to the signal processor each time, wherein P is a positive integer, and $P<N$;

wherein the signal processor is electrically connected to the data processing circuit, the signal processor is configured to convert the video signals of the P pixels into data drive signals and output data drive signals of Q pixels in the one frame of picture to the data processing circuit each time at a second preset transmission speed, wherein Q is a positive integer, and $Q\leq N$; and wherein the data processing circuit is configured to convert the data drive signals into display driving signals, sequentially output the display driving signals to pixels in each row, and control the pixels for display.

2. The driver chip according to claim 1, wherein the first preset transmission speed is greater than the second preset transmission speed, and $P<Q$.

3. The driver chip according to claim 1, wherein the first signal processing circuit further comprises a digital signal decoder;

wherein the digital signal decoder is electrically connected to the signal interface circuit, and the digital signal decoder is configured to decode the video signals of each frame of picture received by the signal interface circuit and output video signals of K pixels among the video signals of the one frame of picture at a third preset transmission speed;

wherein the third preset transmission speed is greater than the second preset transmission speed, $K\leq P$, and K is a positive integer.

4. The driver chip according to claim 3, wherein the first signal processing circuit further comprises a signal correction circuit;

wherein the signal correction circuit is electrically connected to the digital signal decoder and the drive controller separately, and the signal correction circuit is configured to perform color correction on the video signals of the pixels in each frame of picture and perform pixel compensation on the video signals of each frame of picture.

5. The driver chip according to claim 4, wherein the signal correction circuit comprises a gamma correction circuit, a saturation and grayscale processing circuit, and a border pixel compensation circuit; and wherein the gamma correction circuit, the saturation and grayscale processing circuit, and the border pixel compensation circuit are sequentially electrically connected.

6. The driver chip according to claim 1, wherein the data processing circuit comprises a storage circuit, a digital-to-analog conversion circuit, and a data driver;

wherein the signal processor is further configured to receive row synchronization signals and data write control signals output from the drive controller and output the data drive signals and clock trigger signals of the Q pixels at the second preset transmission speed according to the row synchronization signals and the data write control signals;

wherein the storage circuit is electrically connected to the signal processor and the digital-to-analog conversion circuit separately, the storage circuit comprises a plurality of storage sub-circuits corresponding to one row of pixels;

wherein each of the plurality of storage sub-circuits stores data drive signals of a respective pixel disposed in a same row output from the signal processor, and the storage circuit is configured to receive the data drive signals of the Q pixels output from the signal processor and control data drive signals of the pixels disposed in the same row to be output to the digital-to-analog conversion circuit according to the clock trigger signals;

wherein the digital-to-analog conversion circuit is electrically connected to the data driver, the digital-to-analog conversion circuit is configured to convert the data drive signals of the Q pixels into the display driving signals and output the display driving signals to the data driver;

wherein the data drive signals are digital signals and the display driving signals are analog signals, each column of pixels is electrically connected to a respective output terminal of the data driver, and the data driver is configured to sequentially output, according to a preset drive timing, display driving signals of each row of pixels to the pixels so as to drive each of the pixels for display.

7. The driver chip according to claim 6, wherein the storage circuit comprises a vertical shift register and a latch;

wherein the vertical shift register comprises a plurality of vertical shift register circuits corresponding to the pixels in the same row, and the latch comprises a plurality of latch circuits corresponding to the pixels in the same row.

8. The driver chip according to claim 6, wherein the digital-to-analog conversion circuit comprises a digital-to-analog converter and a gamma voltage generator;

wherein the gamma voltage generator is electrically connected to the digital-to-analog converter, and the gamma voltage generator is configured to output a gamma voltage to the digital-to-analog converter; and wherein the digital-to-analog converter is electrically connected to the storage circuit and the data driver separately, and the digital-to-analog converter is configured to convert the data drive signals into the display driving signals in a one-to-one correspondence according to the gamma voltage and the data drive signals.

9. The driver chip according to claim 1, wherein the second signal processing circuit further comprises a row driver;

wherein the signal processor is further electrically connected to the row driver, and the signal processor is further configured to receive column synchronization signals and data write control signals output from the drive controller and output first clock control signals to the row driver according to the column synchronization signals and the data write control signals; and wherein each row of pixels are correspondingly electrically connected to a respective output terminal of the row driver; and the row driver is configured to sequentially provide a row drive signal to each row of pixels according to the first clock control signals so that each of the display driving signals is written into a respective row of pixels.

10. The driver chip according to claim 1, wherein each of the pixels comprises a plurality of sub-pixels of different colors;

wherein the second signal processing circuit further comprises a plurality of multiplex gating circuits and a plurality of clock signal lines, each of the plurality of multiplex gating circuits comprises a plurality of switching circuits, an input terminal of each of the plurality of switching circuits in a same multiplex gating circuit is electrically connected to a same display driving signal output terminal of the data processing circuit; control terminals of the plurality of switching circuits in the same multiplex gating circuit are electrically connected to different clock signal lines, and an output terminal of each of the plurality of switching circuits is electrically connected to a respective one column of sub-pixels; and wherein each of the plurality of clock signal lines is electrically connected to a respective clock signal output terminal of the data processing circuit, and the data processing circuit is further configured to output different second clock control signals to the plurality of clock signal lines so that each of the plurality of switching circuits is turned on or off under control of each of the different second clock control signals;

wherein in response to the second clock control signals controlling the plurality of switching circuits to turn on, the display driving signals are controlled to be transmitted to all columns of sub-pixels in a one-to-one correspondence.

11. The driver chip according to claim 1, further comprising a connector;

wherein the connector is configured to be electrically connected to the bridge chip and the screen driver chip, and/or the connector is configured to be electrically connected to the bridge chip and a system motherboard.

12. The driver chip according to claim 11, wherein the connector comprises a printed circuit board.

13. The driver chip according to claim 1, wherein the first substrate and the second substrate are each a silicon-based substrate.

14. A display screen, comprising the driver chip according to claim 1;

wherein the second substrate of the screen body chip comprises a display area and a non-display area surrounding the display area, the pixels are configured in the display area, and the second signal processing circuit is configured in the non-display area.

15. A display device, comprising the display screen according to claim 14.

* * * * *